US005280961A

United States Patent [19]

Rohloff

[11] Patent Number: 5,280,961

[45] Date of Patent: Jan. 25, 1994

[54] POCKET CALENDAR FOR GREETING OR NOTE CARDS

[76] Inventor: Charles A. Rohloff, P.O. Box 400, Territorial Rd., Evansville, Wis. 53536

[21] Appl. No.: 823,519

[22] Filed: Jan. 21, 1992

[51] Int. Cl.[5] ..... B65D 27/00

[52] U.S. Cl. ..... 283/2; 40/122; 229/70; 229/92.8

[58] Field of Search ..... 229/92.8, 70; 283/2, 283/3, 4; 40/122, 107

[56] References Cited

U.S. PATENT DOCUMENTS

| | | | |
|---|---|---|---|
| 296,934 | 4/1884 | Cussons . | |
| 1,019,275 | 3/1912 | Press . | |
| 2,045,944 | 6/1936 | Domke . | |
| 2,243,974 | 6/1941 | Mitchell . | |
| 2,263,528 | 11/1941 | Wissman . | |
| 2,277,265 | 3/1942 | Zahniser . | |
| 2,282,630 | 5/1942 | Winford . | |
| 2,354,589 | 7/1944 | Georgi . | |
| 2,417,982 | 3/1947 | Histed . | |
| 2,681,175 | 6/1954 | David . | |
| 3,652,007 | 3/1972 | MacDougall . | |
| 3,894,755 | 7/1975 | Cieslak et al. . | |
| 4,079,881 | 3/1978 | Sabb . | |
| 4,276,703 | 7/1981 | Brindley . | |
| 4,451,067 | 5/1984 | Williams . | |
| 4,515,838 | 5/1985 | Miyajima . | |
| 4,589,590 | 5/1986 | McGuire et al. . | |
| 4,613,157 | 9/1986 | Drabish . | |
| 4,681,253 | 7/1987 | Engelhardt . | |
| 4,720,123 | 1/1988 | Chelius . | |
| 4,757,624 | 7/1988 | Holec . | |
| 4,780,975 | 11/1988 | Friedman . | |
| 4,948,034 | 8/1990 | Rohloff . | |
| 4,975,061 | 12/1990 | Avrill . | |
| 4,997,126 | 3/1991 | Amoss . | |
| 5,104,146 | 4/1992 | Schulz et al. | 283/2 X |
| 5,106,122 | 4/1992 | Perelman | 283/2 |
| 5,131,587 | 7/1992 | Staub | 283/2 |

*Primary Examiner*—Mark Rosenbaum
*Assistant Examiner*—Willmon Fridie, Jr.
*Attorney, Agent, or Firm*—Ross & Stevens

[57] ABSTRACT

A pocket calendar is disclosed which has a paper blank cut and folded to present a calendar having a pocket therein for receiving a greeting card, note card or the like. The paper blank includes a wall-hanger panel, a back pocket panel adjacent the wall-hanger panel along a fold line, a front pocket panel adjacent the back pocket panel along a second fold line, and a calendar panel adjacent the front pocket panel along a score line. The front pocket panel is folded to overlie the back pocket panel and affixed to the back pocket panel to form a pocket. Preferably, a portion of the greeting card is removably positioned within the pocket. A calendar is fixed to the calendar panel. The paper blank may be made such that the pocket portion can be separated from the remainder of the paper blank to form a mailing envelope for the greeting card.

2 Claims, 3 Drawing Sheets

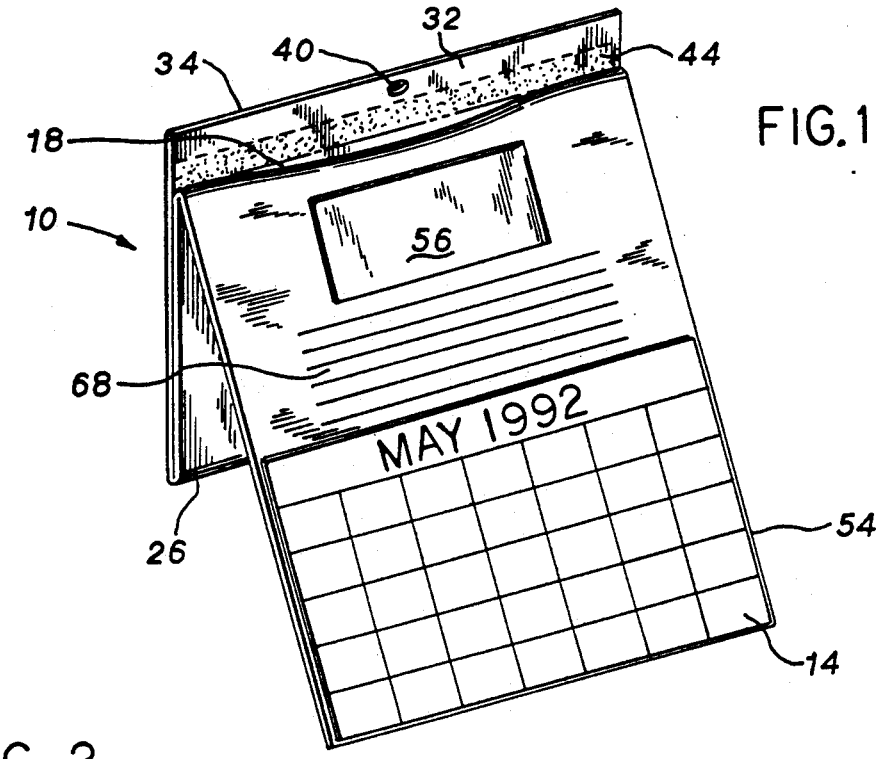
FIG. 1
FIG. 2
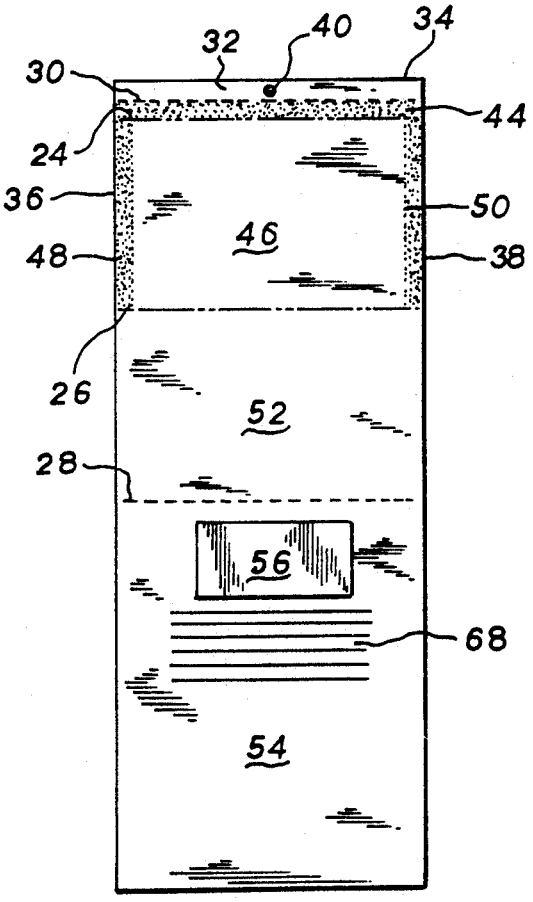
FIG. 3
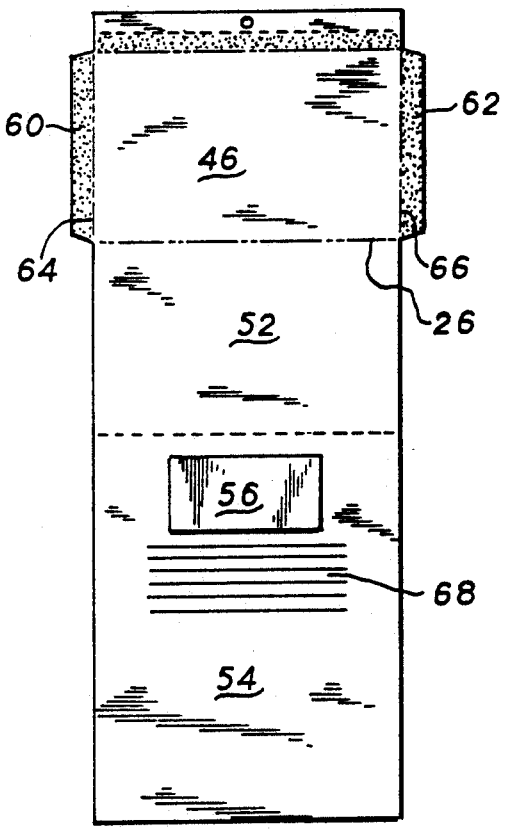

FIG. 4a
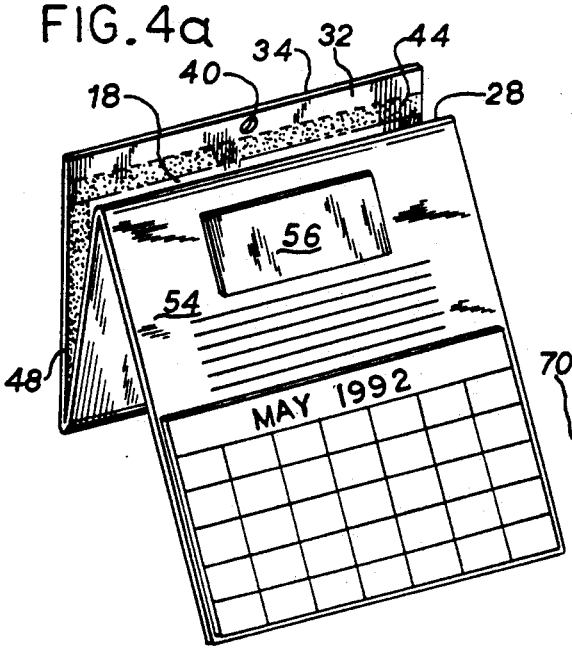
FIG. 4b
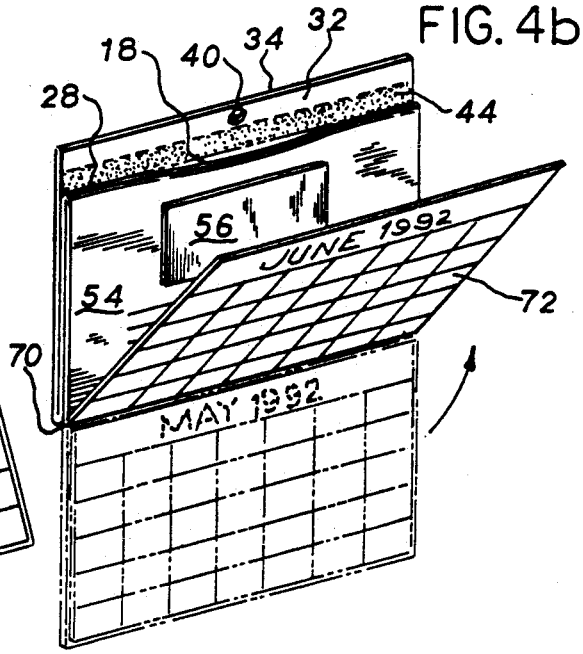
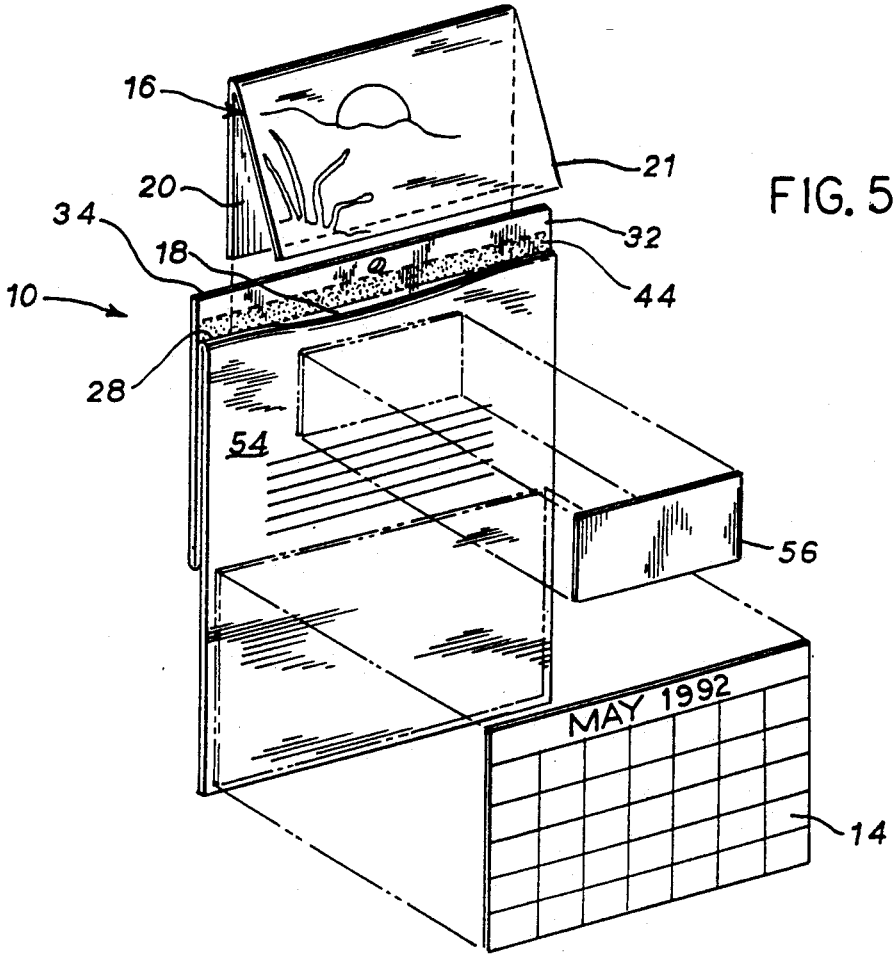
FIG. 5

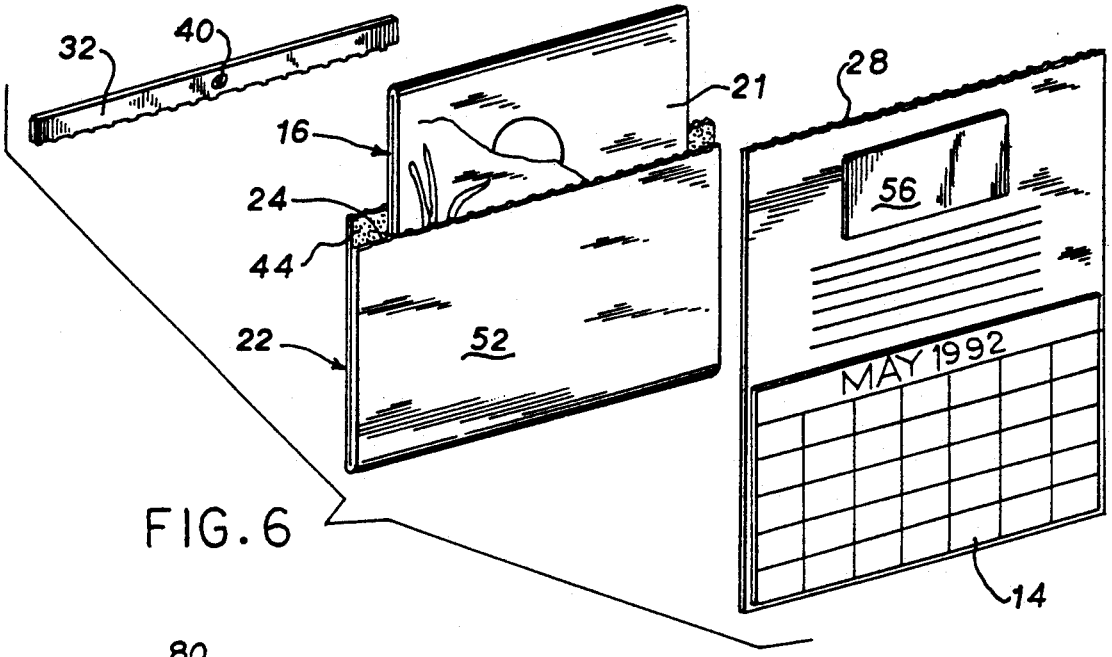
FIG. 6
FIG. 7
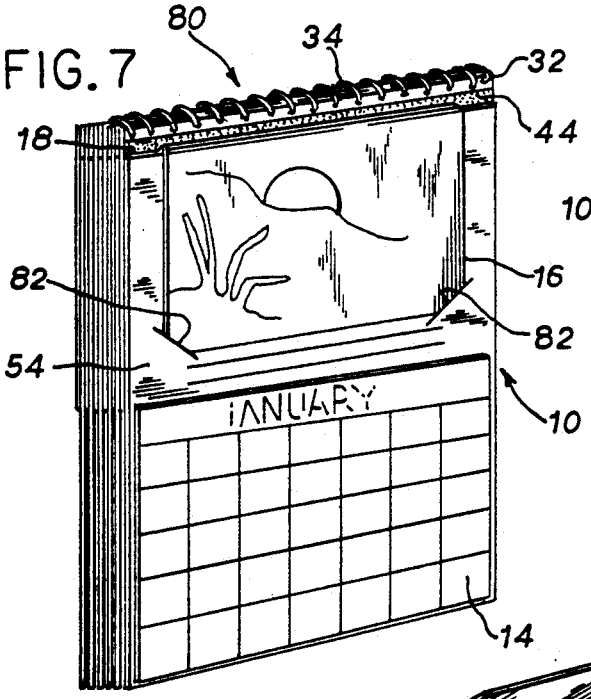
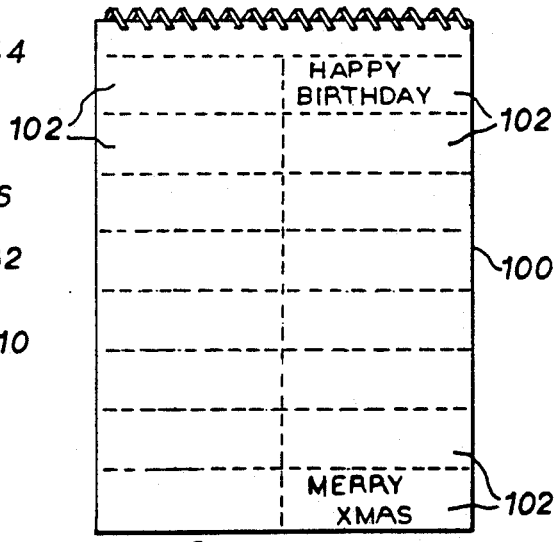
FIG. 8
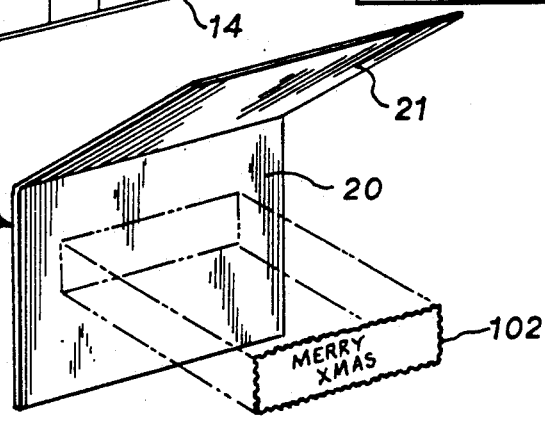
FIG. 9

POCKET CALENDAR FOR GREETING OR NOTE CARDS

FIELD OF THE INVENTION

The present invention is directed to calendars in general and to calendars with removable greeting cards in particular.

BACKGROUND OF THE INVENTION

Along with the functional attributes of providing a means to determine the date and to remind one of specific events occurring on that date, calendars are often accompanied by photographs, artwork, or other artistic image areas to enhance their aesthetic quality. Common varieties of calendars feature spiral bound pages with an image area on one side of the page and a calendar for the preceding month on the other side of the page. Other calendars feature image areas and calendar pages bound separately so that a calendar page may be changed without disturbing the image area page. Another calendar embodiment features different image areas for a defined segment of the calendar. For example, a calendar may consist of one page for each month. Each page includes an image area and a monthly calendar.

One of the drawbacks of calendars is that, when the calendar has expired, the image area is usually discarded as being of no further use. In order to provide a use for the image area, some calendars have been designed to utilize detachable postcards, as disclosed in U.S. Pat. No. 2,263,528 to Wissman and in U.S. Pat. No. 4,757,624 to Holec. This increases the value of the calendar as the postcard may be detached and used prior to discarding the out-of-date calendar.

Another type of calendar is disclosed in my U.S. Pat. No. 4,948,034, which is directed to a card calendar. In my card calendar, a segmented illustrated greeting or note card is adhesively affixed to a panel above the date portion of a calendar. When the calendar has expired, the greeting card may be placed within an envelope, which is part of the calendar package. The envelope is then removed and the greeting card/envelope combination may be used after the calendar has been discarded.

SUMMARY OF THE INVENTION

While my prior U.S. Pat. No. 4,948,034 affords significant advantage in utility over previous calendars, the present invention adds an even further improvement by avoiding the requirement for adhesives to hold the card in place. As such, a pocket calendar may be formed having specific use for a greeting card but also other uses for cards, receipts and the like. The pocket calendar comprises a paper blank including a wall-hanger panel having an upper edge, and a back pocket panel adjacent the wall-hanger panel along a first fold line. A front pocket panel is placed adjacent the back pocket panel along a second fold line. A calendar panel is adjacent the front pocket panel along a first score line. The front pocket panel is folded to overlie the back pocket panel and affixed to the back pocket panel to form a pocket. A card, such as a greeting card, note card or similar object, may be removably placed in the pocket, such that the image area of the greeting card is visible. A calendar is affixed to the calendar panel. The pocket calendar may also include a space for notes and for detachable coupons.

The pocket calendar of the present invention is constructed so that a user may removably affix a greeting card or the like to the pocket. Because the greeting card is not adhesively affixed to the pocket calendar, greeting cards may be interchanged even prior to the expiration of the calendar.

The pocket calendar is designed to include an envelope. After the calendar has expired, the user may remove the pocket portion from the pocket calendar and convert it to envelope form for use with the greeting card.

A number of card calendars may be joined along the upper edge of the pocket calendar to present sequential calendars to cover any period of time.

The pocket calendar combination of the present invention enables the repeated use of a pictorial display or greeting card first in a display mode in connection with a calendar and second in a mailing mode as a mailable card for personal or holiday messages.

The pocket calendar of the present invention is flexible in design to enable the user to customize the calendar to the user's desires. For example, it is within the scope of the present invention to provide a pocket calendar assembly having several pockets each in combination with a calendar. The assembly may also include a variety of greeting cards. The calendar user may then determine which greeting card will be combined with an appropriate calendar.

The card calendar of the present invention is also provided with an alternate calendar panel to enable the same card calendar to be kept on sale for up to two years.

Further objects, features and advantages of the invention will be apparent from the following detailed description taken in conjunction with the accompany drawings showing the preferred embodiment of the invention.

BRIEF DESCRIPTION OF THE DRAWINGS

FIG. 1 is a perspective view of the pocket calendar of the present invention.

FIG. 2 is a plan view of the paper blank of the pocket calendar of the present invention.

FIG. 3 is a plan view of an alternative embodiment of the paper blank of FIG. 2.

FIG. 4A is a perspective view of the paper blank of FIG. 2 in partially folded condition.

FIG. 4B is a perspective view of an alternative embodiment of the pocket calendar with an alternate calendar folded into view.

FIG. 5 is an exploded view of the pocket calendar of the present invention showing the position of the card and the calendar.

FIG. 6 is an exploded view of the pocket calendar of the present invention showing the card partially inserted in the envelope pocket with the discarded portions of the pocket calendar visible.

FIG. 7 is a perspective view of another embodiment of the present invention illustrating a one year assembly of pocket calendars.

FIG. 8 is a rear elevational view of the back side of the embodiment of FIG. 7 illustrating yet a further embodiment of the card calendar with message labels for placement on the greeting card.

FIG. 9 is a perspective view of an alternative embodiment of a greeting card for use with or without the pocket calendar, in which the greeting card receives an adhesive label.

DESCRIPTION OF THE PREFERRED EMBODIMENT

Referring now to the figures wherein like numerals refer to similar parts, FIGS. 1–6 illustrate a pocket calendar 10, which includes a foldable paper blank 12 to which may be affixed a calendar 14. The calendar 14 is a standard design calendar covering any desired time period, from one day to a year or longer.

As illustrated successively in FIGS. 1–6, the paper blank 12 serves three primary functions. First, in a calendar mode, the paper blank 12 forms a backing for the calendar 14, as illustrated primarily in FIGS. 1 and 5. Second, in a pocket mode, the paper blank 12 forms a pocket 18 for receiving two-dimensional cards, papers and the like, as illustrated in FIGS. 5 and 7. In a preferred mode, the pocket 18 is designed to receive the rear segment 20 of a folded card 16, as illustrated in FIG. 6. For purposes of the present invention, the term "card" or "greeting card" includes greeting cards, note cards, and similar objects suitable for placement in the pocket 18. Third, in an envelope mode, the paper blank 12 may be altered to form an envelope 22 for the card 16, as illustrated primarily in FIG. 6.

Turning now to FIG. 2, the paper blank 12 may be formed of a single sheet of paper cut to desired dimensions and provided with perforations and fold lines as required. The paper blank 12 includes first and second fold lines 24, 26, respectively, indicated by the solid interior double lines, and first and second score lines 28, 30, respectively, indicated by broken interior lines. The score lines are preferably perforated, which serve to facilitate tearing of the paper blank. The paper blank 12 also includes a wall-hanger panel 32 defined by the upper edge 34 of the paper blank 12, the first side edge 36, the second side edge 38, and the first fold line 24. Preferably, the wall-hanger panel 32 includes means to hang the pocket calendar 10 on a wall. While a number of different means may be used, preferred means include a wall-hanger opening 40, as illustrated in FIG. 2 or a spiral binding 42, as illustrated in FIG. 7. The spiral binding 42 can be made of a variety of materials known to the art. Examples include metal and plastic wire. It is within the scope of the present invention to provide means to hang the pocket calendar from a wall other than those described herein.

In the preferred mode, the pocket calendar 10 will convert to an envelope 22, as illustrated in FIG. 6. In the envelope mode, the paper blank 12 is designed such that the wall-hanger panel 32 includes a seal panel 44 defined by the first fold line 24 and the second score line 30. The seal panel 44 is preferably adhesively coated and adapted to seal the envelope 22. In the envelope mode, the seal panel 44 is separated from the remainder of the wall-hanger panel 32 by the second score line 30.

Continuing with the description of the paper blank 12, a back pocket panel 46, which forms the back of the pocket portion of the pocket calendar 10 or alternatively the back of the envelope 22 when the paper blank 12 is in the envelope mode, is separated from the wall-hanger panel 32 by the first fold line 24. The back pocket panel 46 includes a first adhesive area 48 and a second adhesive area 50 adjacent first and second side edges 36, 38. It is within the scope of the present invention to have adhesive areas, similar to areas 48, 50, located on the front pocket panel 52 adjacent side edges 36, 38. In the envelope mode, the size of the card 16 or alternatively the size of the pocket 18 would have to be adjusted to accommodate each other.

A front pocket panel 52 is situated adjacent the second fold line 26 and first score line 28. The front pocket panel 52 is adapted to fold on the second fold line 26 to cover and be adhesively adhered to back pocket panel 46 as illustrated in FIG. 4.

A calendar panel 54 adapted for printing or otherwise affixing a calendar 14 is situated adjacent the front pocket panel 52 and separated therefrom by the first score line 28. The calendar portion optionally includes an area 56 which may be perforated to include a removable coupon, business card or the like.

The paper blank 12 is preferably formed of any paper appropriate for use as an envelope such as a medium weight opaque bond paper. The paper blank 12 may also be fabricated of fabric or an appropriate flexible plastic material. In general, the material forming the paper blank 12 will be chosen to coordinate in color and texture with the appearance of the card 16 if the pocket calendar 10 is formed with an envelope 22. The dimensions of the paper blank 12 may vary depending on a number of factors, such as the size of the calendar, the use intended, or the size of the card 16 used in the pocket calendar 10. If the pocket calendar is formed with an envelope, the back pocket panel 46 and all the vertically adjacent portions of the paper blank 12 should be slightly wider than the width of the card 16. The back pocket panel 46 and the front pocket panel 52 are of equivalent dimensions and should be slightly taller than the height of the card 16. The height of the calendar panel 54 should be such to be able to accommodate the dimensions of the calendar 14 and the card 16 without any overlap. The seal panel 44 is large enough to have sufficient area to form a tight seal when coated with adhesive and used to close the envelope 22 as described below.

Referring now to FIG. 3, it is within the scope of the present invention to include first and second adhesive flaps 60, 62 separated from the back pocket panel 46 by fold lines 64, 66 respectively. The glue flaps are generally outwardly extending paper flaps that serve to affix the back pocket panel 46 to the front pocket panel 52, which is adjacent the back pocket panel along a fold line 26.

Referring now to FIG. 4A, the paper blank 12 is folded as illustrated to form the pocket calendar 10 by folding the front pocket panel 52 along the second fold line 26 to overlie the back pocket panel 46. The front pocket panel 52 and the back pocket panel 46 are then adhesively connected by the first and second adhesive areas 48, 50, or alternatively first and second adhesive flaps 60, 62, to form a pocket 18. While not preferred, other means of attachment such as staples may be used. The calendar panel 54 is then folded along the first score line 28 to drape down over the pocket 18. The facing side of the calendar panel 54 preferably includes the calendar 14, as illustrated in FIG. 1, and is spaced for notes 68 and a coupon area 56, also as illustrated in FIG. 1. The calendar 14 may be a separate paper item as illustrated in FIG. 5 or it may be printed directly on the calendar panel 54 as illustrated in FIG. 1.

Referring to FIG. 4B, the calendar panel 54 may optionally be provided with a third fold line 70. Optionally, an alternate calendar panel 72, also adapted for the printing or other affixing of a calendar, may be located on the reverse side of the calendar panel 54. The optional calendar panel 72 preferably contains a calendar covering a month different than the calendar on calendar panel 54. In this way, a single pocket calendar 10 may serve for a two-month period. The alternate calendar panel 72 is brought into view, as shown in FIG. 4B, by folding the alternate calendar panel 72 along the fold line 70 so that the alternate calendar panel overlies the calendar panel 54. The alternate calendar panel 72 may be taped, stapled, glued or otherwise affixed into place.

Reference is now made to FIG. 5 which illustrates the combination of the use of the pocket calendar 10, the calendar 14 and the greeting card 16. The card 16 is placed such that the rear segment 20 of the card is positioned in the pocket 18 of the pocket calendar 10.

The image area 21 of the card 16 serves as the decorative image area for the combined unit. With the card 16 affixed to the pocket 18 of the pocket calendar 10, the calendar may then be displayed. The image area 21 presents an attractive appearance for the calendar. The calendar 14 is clearly presented for reference directly beneath. The portion of the calendar panel 54, which is hidden from view by the card 16, may be conveniently used for notes or the display of promotional items, such as business cards or coupons 56, as illustrated in FIGS. 1 and 5. The pocket calendar may then be conveniently hung on a wall by placing the wall-hanger opening 40 in the paper blank 12.

The assembly just described conveniently allows the positioning of any card 16 on the pocket calendar without the requirement for affixing by an adhesive. In this manner, cards may be interchanged at any time. A card 16 is also conveniently ready to be used in another pocket calendar 10, which may be designated with a different calendar date.

After the periods covered by the calendars 14, 72 of the pocket calendar 10 have passed, the card 16 may be used as a greeting card. To use the card 16 as a greeting card, the card 16 is removed from the pocket 18. The desired message is written in the interior of the card 16 and the card is inserted in the envelope pocket 18, as illustrated in FIG. 5. Because the pocket calendar 10 for that month no longer has utility, the wall-hanger panel 32 is separated from the seal panel 44 along the second score line 30. In like manner, the calendar panel 54 is separated from the front pocket panel 52 along the first score line 28. The remainder is the card 16 within the envelope 22.

The card 16 is fully inserted within the envelope, and the seal panel 44 is folded along the first fold line 24 and sealed with glue or other adhesive to the front pocket panel 52. Preferably, an adhesive coating is placed on the seal panel 44 such that when water is applied to the coating and the seal panel 44 is pressed into place, the envelope 22 is sealed. The envelope 22, with the card 16 sealed in the envelope pocket 18, is then ready to be deposited in the mail.

As illustrated in FIG. 7, a number of pocket calendars 10 may be combined into a pocket calendar assembly 80 to collectively cover an extended period of time. The individual pocket calendars 10 are joined along the upper edge 34 by the binding 42. As described previously, the binding 42 may be a plastic tension binding, or an adhesive-type binder. The binding 42 is preferably a wire or plastic spiral binder running through holes punched in the top portion of the wall-hanger panel 32.

The rear segment 20 of a card 16 is then conveniently placed in the pocket 18 of each pocket calendar 10. If desired, the calendar panel 54 may be provided with slots 82 to temporarily affix the corners of the card 16 to the calendar panel.

As the period covered by the pocket calendar 10 expires, the pocket calendar may be removed from the pocket calendar assembly 80 by tearing along the binding 42, or alternatively the second score line 30. The pocket calendar 10 may then be converted into an envelope 22 as described above. The card 16 may then be used as a greeting card. Because the card 16 does not have to be adhesively mounted to the pocket calendar 10, the card 16 associated with a specific pocket calendar 10 may be interchanged with any other card in the assembly 80.

If desired, the usefulness of the pocket calendar 80 may be extended by incorporating the alternate calendar embodiment illustrated in FIG. 4B.

The resulting pocket calendar 10 and the pocket calendar assembly 80 serves as a convenient storage article for cards 16 and other papers, which may be stored in pocket 18.

The utility of the pocket calendar 18 may be extended by adding the features illustrated in FIGS. 8 and 9. Referring now to FIGS. 8 and 9, there is illustrated a sheet 100, which may conveniently be a support back of a pocket calendar 10 or pocket calendar assembly 80. The sheet 100 serves also as a backing for adhesive labels 102. As illustrated, adhesive message labels 102 may be provided with a variety of sayings from typical holiday greetings to specific, customized messages. The labels 102 are removably affixed to the sheet 100. In assembled form, the pocket calendar/greeting card combination then has the added flexibility of a variety of messages to be attached to the greeting card 16. When the card is to be used, it is simply removed from the pocket 18, as illustrated in FIG. 5. The desired label 102 is removed from the sheet 100 and affixed to the card 16 in the manner illustrated in FIG. 9. The card has then been customized according to the user's desires.

The pocket calendar 10 and pocket calendar assembly 80 disclosed herein may be advantageously used as a promotional item. Businesses with year-round activities, such as recreational and sporting events, may wish to use the assembly 80 for an entire year of promotion covering all months and various uses of their seasonal products or services. In addition to printing advertisements or coupons on the calendar panel 54, an advertiser may make use of the calendar panel 54, for additional messages.

It is understood that the invention is not confined to the particular construction and arrangement herein illustrated and described but embraces such modified forms thereof as come within the scope of the following claims.

What is claimed is:

1. A pocket calendar comprising:

a. a paper blank including a wall hanger panel having an upper edge, wherein the wall hanger panel comprises a wall hanger opening flap and a seal panel adjacent the wall hanger opening flap along a second score line, a back pocket panel adjacent the wall hanger panel along a first fold line, a front pocket panel adjacent the envelope back panel along a second fold line, means to affix the back pocket panel to the front pocket panel, and a calendar panel adjacent the front pocket panel along a first score line, wherein the front pocket panel is folded to overlie the back pocket panel and affixed to the back pocket panel to form an envelope;

b. a card removably positioned within the envelope;
c. a calendar affixed to the calendar panel; and
d. a sheet comprising a plurality of message labels for affixing desired messages to the card.

2. A pocket calendar assembly comprising:
a. a plurality of pocket calendars, each card calendar including a paper blank having a wall hanger panel with an upper edge, a back pocket panel adjacent the wall hanger panel along a first fold line, a front pocket panel adjacent the envelope back panel along a second fold line, means to affix the back pocket panel to the front pocket panel, and a calendar panel adjacent the front pocket panel along a first score line, wherein the front pocket panel is folded to overlie the back pocket panel and affixed to the back pocket panel to form an envelope;
b. a series of greeting cards adapted for insertion in the envelope;
c. a calendar fixed to each calendar panel of the pocket calendar; and
d. a plurality of expression labels for affixing to the greeting card.

* * * * *